US005743821A

United States Patent [19]

Wirachowski

[11] Patent Number: 5,743,821

[45] Date of Patent: Apr. 28, 1998

[54] SCRUM MACHINE

[76] Inventor: Kevin Wirachowski, 900 Whittaker Road, Malahat, British Columbia, Canada, V0R 2L0

[21] Appl. No.: 652,658

[22] Filed: May 28, 1996

[30] Foreign Application Priority Data

May 25, 1995 [CA] Canada ..... 2150196

[51] Int. Cl.[6] ..... A63B 67/00

[52] U.S. Cl. ..... 473/441; 473/445

[58] Field of Search ..... 273/55 R, 55 A, 273/451; 434/251; 473/422, 438, 441, 442, 443, 444, 445

[56] References Cited

U.S. PATENT DOCUMENTS

| | | | |
|---|---|---|---|
| 2,644,334 | 7/1953 | Perry | 273/55 R |
| 3,458,192 | 7/1969 | Trice | 273/55 R |
| 4,844,459 | 7/1989 | Francis et al. | 273/55 |
| 5,474,290 | 12/1995 | Rascona et al. | 273/55 R |

FOREIGN PATENT DOCUMENTS

| | | | |
|---|---|---|---|
| 1252804 | 4/1989 | Canada | A63B 69/00 |
| 2052272 | 6/1979 | United Kingdom | A63B 69/00 |
| 2239182 | 6/1991 | United Kingdom | 434/251 |
| 2276091 | 8/1992 | United Kingdom | A63B 69/00 |
| 2257917 | 1/1993 | United Kingdom | 273/55 R |
| 2276091 | 9/1994 | United Kingdom | 273/55 A |

*Primary Examiner*—William M. Pierce
*Attorney, Agent, or Firm*—Anthony R. Lambert

[57] ABSTRACT

A scrum machine with an articulated head formed of an extendable actuator arm mounted on the forward end of the scrum machine and extending upwardly from the ground, and preferably extending forwardly as well, with a pad carrying forward thrusting ram pivotally mounted on a pivot on the extendable actuator arm and locatable in selected angular positions about the pivot. An angle actuator controllably changes the angular position of the forward thrusting ram about the pivot. The angle actuator is pivotally attached to an end of the forward thrusting ram remote from the pad and pivotally mounted on the extendable actuator arm. A scrum machine having a movable pad carrying head is provided with a ground engaging base that includes a front wheel mounted on the forward end of the frame and a rear wheel or wheels mounted for steering about a substantially vertical axis on the rearward end of the frame. Steering of the rear wheel or wheels is controlled by a steering actuator. The rear wheel or wheels are braked, according to one aspect of the invention, by an adjustable resistance brake controlled by a braking actuator.

29 Claims, 7 Drawing Sheets

SCRUM MACHINE

FIELD OF THE INVENTION

This invention relates to scrum machines, used in training rugby football players for scrummaging.

BACKGROUND OF THE INVENTION

Various prior scrum machines have attempted to provide an artificial scrum for a real scrum to practice with, such as those described in U.S. Pat. No. 4,844,459; and United Kingdom patent applications 2,052,272; 2,257,917; and 2,276,091. In various forms, these scrum machines provide movable player contact heads. However, each of these prior art scrum machines, it is believed, has limitations on the range of motion of the player contact heads and on the control of motion of the scrum machine itself.

SUMMARY OF THE INVENTION

It is believed that this invention provides a greater range of motion for the player contact heads and greater motion control of a scrum machine in comparison to the prior art and therefore provides an increased degree of realism for a scrum machine.

There is therefore provided according to one aspect of the invention a scrum machine with an articulated head formed of an extendable actuator arm mounted on the forward end of the scrum machine and extending upwardly from the ground, and preferably extending forwardly as well, with a pad carrying forward thrusting ram pivotally mounted on a pivot on the extendable actuator arm and locatable in selected angular positions about the pivot.

In a further aspect of the invention, there is provided an angle actuator for controllably changing the angular position of the forward thrusting ram about the pivot. The angle actuator is preferably pivotally attached to an end of the forward thrusting ram remote from the pad and pivotally mounted on the extendable actuator arm.

According to a still further aspect of the invention, a scrum machine having a movable pad carrying head is provided with a ground engaging base that includes a front wheel mounted on the forward end of the frame and a rear wheel or wheels mounted for steering about a substantially vertical axis on the rearward end of the frame. According to one aspect of the invention, steering of the rear wheel or wheels is controlled by a steering actuator. The rear wheel or wheels are braked, according to one aspect of the invention, by an adjustable resistance brake controlled by a braking actuator.

The scrum machine preferably includes a pair of forward thrusting rams, and these rams are preferably pneumatically operated.

According to a still further aspect of the invention, there is provided a ground engaging scrum machine including an articulated head in which the articulated head includes a pad carrying forward thrusting ram pivotally mounted on a vertically adjustable pivot on a forward end of the frame, the pad carrying forward thrusting ram being locatable in selected angular positions about the pivot.

There is also provided in accordance with one aspect of the invention, an improved method of operating the scrum machine in which application of forward thrust pressure to the forward thrusting ram is automatically initiated upon sensing of contact of a player with the forward thrusting ram.

In a further aspect of the invention, a scrum machine is provided that includes:

a frame having a forward end, a rearward end and a ground engaging base;

a first forward thrusting ram pivotally mounted on the frame;

a first pad mounted on the first forward thrusting ram;

a sensor to sense contact of a player with the forward thrusting ram; and means to supply pressure to the forward thrusting ram upon receipt of a signal from the sensor indicating contact of the player with the forward thrusting ram.

These and other aspects of the invention are described in more detail in the detailed description of the invention and claimed in the claims that follow the detailed description.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
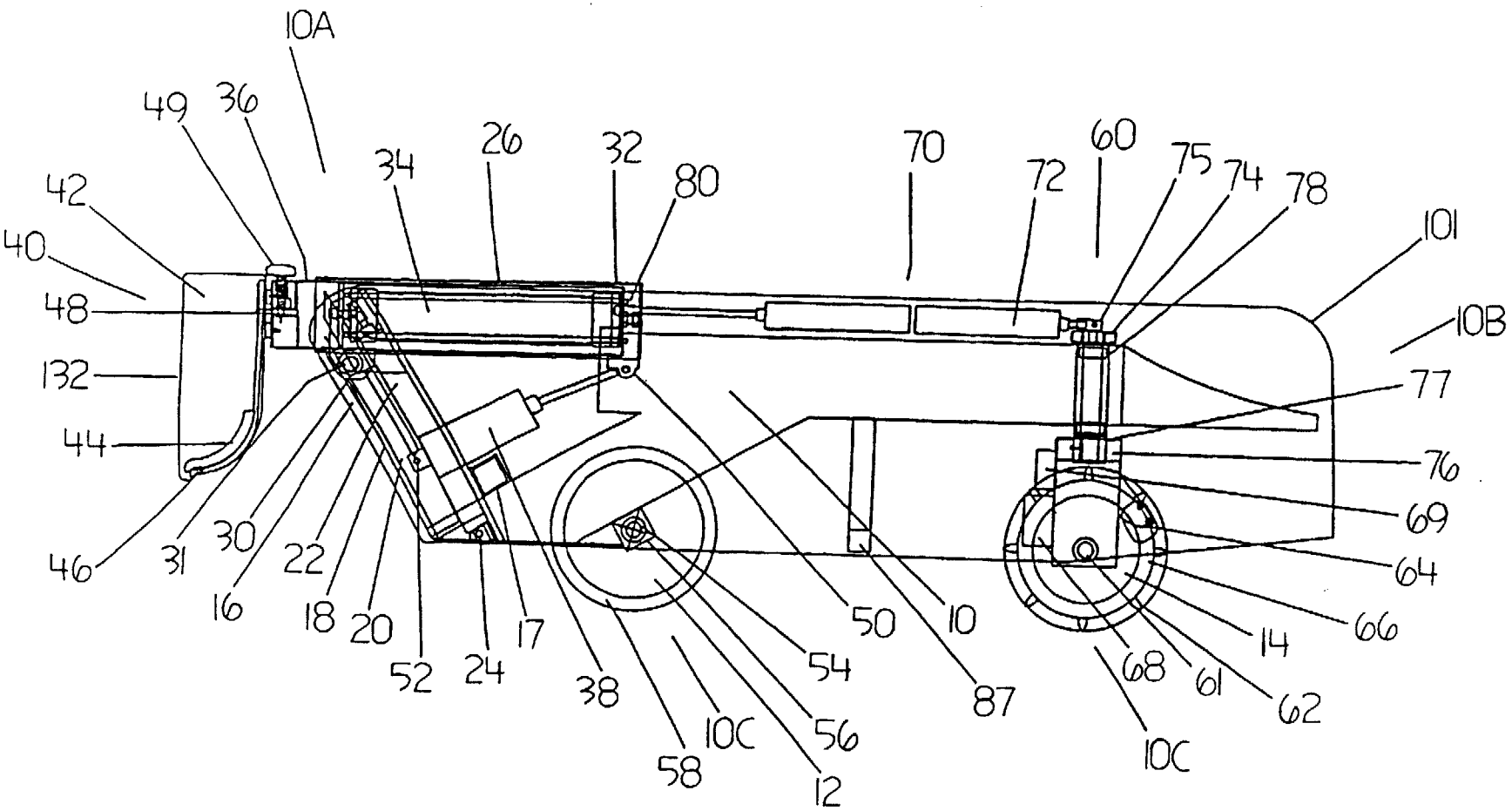
FIG. 1 is a side view schematic of an embodiment of the scrum machine of the invention.
Figure 2:
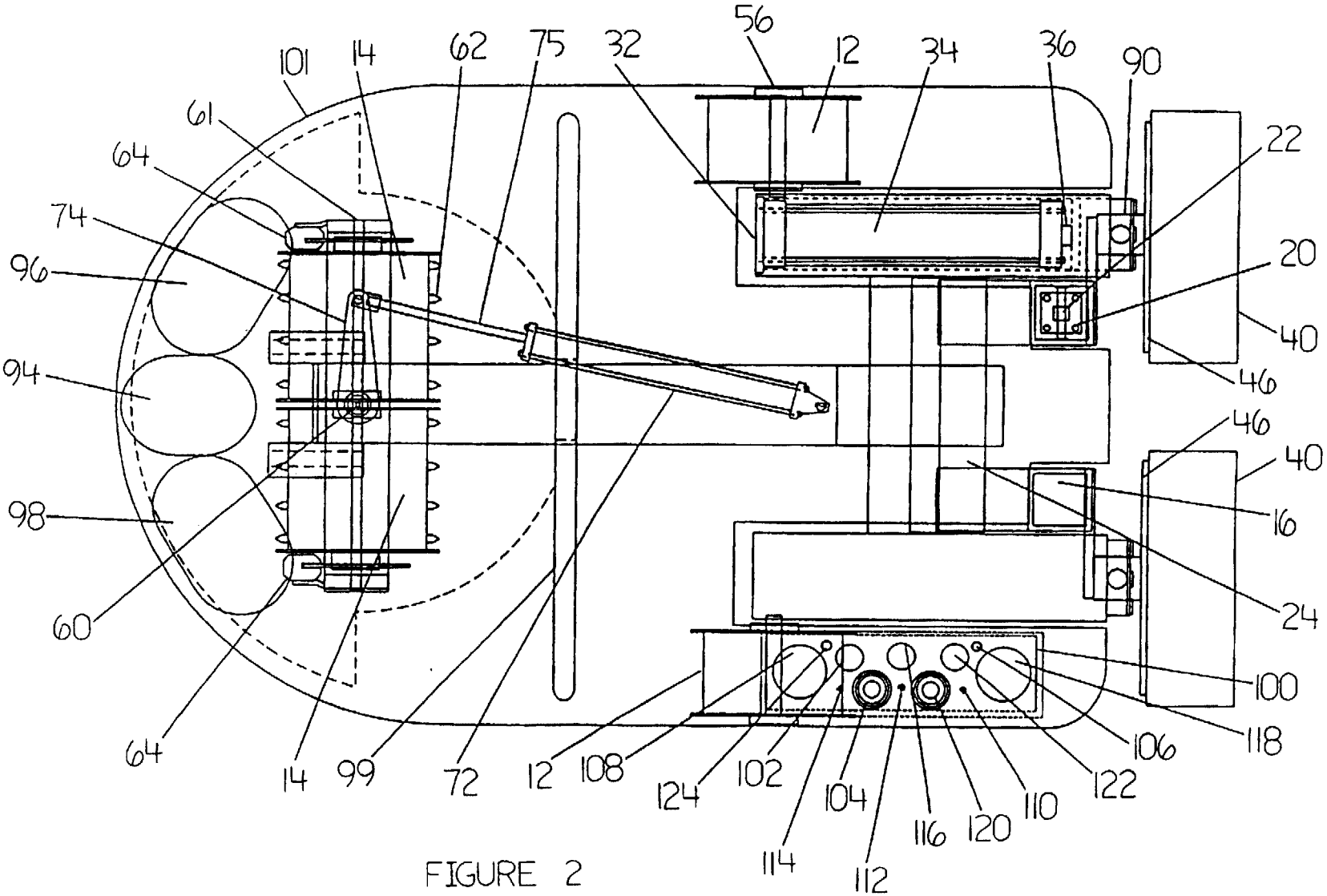
FIG. 2 is a top view schematic of the scrum machine of FIG. 1.
Figure 3:
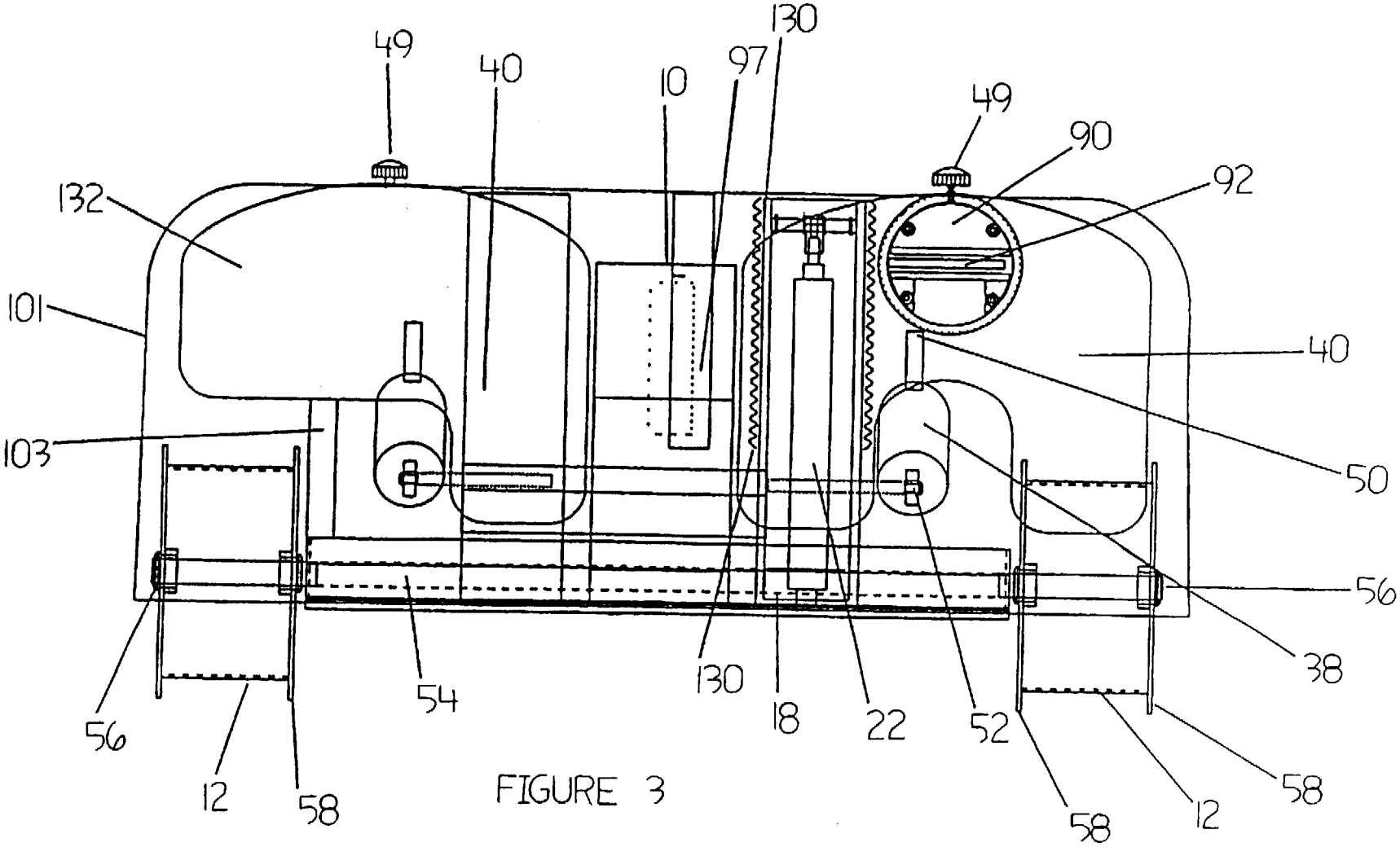
FIG. 3 is a front view schematic of the scrum machine of FIG. 1.

Referring to FIGS. 1, 2 and 3 in particular, there is shown a scrum machine having a frame 10 having a forward end 10A, a rearward end 10B and a ground engaging base 10C formed of wheels 12 and 14. One side of the scrum machine is shown in FIG. 1. The frame 10 is preferably made of steel and provides underlying support structure for all moving components and subsystems of the machine including wheels 12 and 14, and an optional cover 101 shown in outline. The cover 101 may be moulded fibreglass. The scrum machine shown in FIG. 1 provides articulated player contact heads that can be actively moved through a wide variety of contact angles and heights, and provide adjustable pressure and cushioned pressure to a player. The articulated player contact head 28 shown in FIG. 1 includes contact pad 40, extendable actuator arm 16 (changes elevation of the head), angle actuator 38 (changes angle of the pad in relation to the extendable actuator arm 16) and forward thrusting ram 26. These features will now be described in more detail.

Two extendable actuator arms 16 are mounted on the forward end 10A of the frame 10. Only one of the extendable actuator arms 16 will be described since they are identical. The extendable actuator arm 16 is mounted on a structural cross-member 17 which itself is supported on a forward part of the frame 10. The frame 10 is centrally located so that the cross-member 17 extends on either side of the frame 10 to support the two extendable actuator arms. The extendable actuator arm 16 is formed of an elevation tower 18 which has an inner slider 20 that telescopes within the elevation tower 18. An elevation air cylinder 22 provides forces to telescope the inner slider 20. The elevation tower 18 is anchored to the inner slider 20 at mount 24. The inner slider 20 is anchored to the air cylinder 22 with a mounting pin (not shown). The extendable actuator arm 16 extends upward, away from the ground engaging base, and forwardly.

Also mounted on a forward part of the frame 10 are a pair of forward thrusting rams 26. Tighthead forward thrusting ram 26 shown in side view in FIG. 1 will be described in some detail, and it will be appreciated that the same description will apply to the loosehead forward thrusting arm 26 on the other side of the frame 10. A forward end of the forward thrusting ram 26 includes a contact pad 40 preferably made of low density foam in a forward section 42 for providing safe initial contact between a player and the pad 40, and high density foam in a rearward section 44 of the pad 40 for providing a safe contact point for the practising player during scrum pressure. The contact pad 40 is mounted on a resilient backing plate 46 that provides a support frame for the foam sections 42 and 44. The backing plate 46 mounts on a mounting tab 48 and is held in place on a forward portion of the forward thrusting ram 26 by retaining pin 49.

The forward thrusting ram 26 is pivotally mounted and supported on a first pivot housing 30 with pivot pin 31 on the first extendable actuator arm 16. The pivot pin 31 provides lateral stability for the forward thrusting ram 26. The forward thrusting ram 26 includes an outer thrust tube 32 which houses a thrust air cylinder 34 and thrust inner tube 36. The inner thrust tube 36 telescopes within the outer thrust tube 32 under pressure from operation of the thrust air cylinder 34. The pressure in the cylinder 34 may be altered to give a controlled active thrust to the pad 40. Depending on the volume of air in the cylinder 34, a controlled passive resistance may also be provided to the forward thrusting ram.

An angle actuator 38 formed of a telescoping air cylinder is mounted between a pin 50 mounted on the rearward end of the forward thrusting ram 26 remote from the pad 40, and a pivot pin 52 on the inner slider 20. The angle actuator 38 controllably changes the angular position of the forward thrusting ram 26 about the pivot 30, thereby enabling the forward thrusting ram 26 to be locatable in selected angular positions about the pivot 30.

The ground engaging base 10 includes two fixed front wheels 12 mounted in self-lubricating bushings 54 and wheel supports 56 on either side of the forward end 10A of the frame 10. Each wheel 12 is mounted outside the inner frame 10, clear of the motion channels required by the forward thrusting rams 26. The front wheels 12 may be non-steerable and need not have brakes. A lateral positioning disc 58 extends around the wheel with a protruding rim to assist in maintaining lateral stability of the scrum machine.

The ground engaging base 10 also includes a pair of rear swivel wheels 14 mounted for rotation about a horizontal axis 61 and steering about a substantially vertical axis 60 on the rearward end 10B of the frame 10. A lateral positioning disc 58 also protrudes outward around the swivel wheels 14 like the wheels 12, and the swivel wheels 14 may be provided with ground engaging spikes 62 to provide traction.

The rear wheels 14 are provided with adjustable resistance brakes formed of a disc brake calliper assembly 64 and a metal braking rotor 66 mounted on the wheels 14. Control of the adjustable resistance of the brakes is provided by a braking actuator formed of a brake booster 68 with brake fluid reservoir 69. The brake booster 68 is pneumatically controlled and provides an air over hydraulic system for remotely controlled variable braking pressure. The brake actuator is of conventional brake actuator construction.

Steering of the rear wheels 14 is provided by a steering actuator 70 formed of a steering air cylinder 72 pivotally coupled to a steering arm 74 at a pin 75. The steering arm 74 itself is rigidly attached to steering fork 76 through a swivel wheel shaft (not shown) and mounting bracket 77. The swivel wheel shaft is supported for rotation within a bushing 78. The axis of the bushing 78 defines the vertical axis 60 of steering of the wheels 14. A pin 80 anchors the air cylinder 72 to the frame 10. The steering actuator 70 allows controlled steering of the swivel wheels 14.

Referring now in particular to FIGS. 2 and 3, the pads 40 are mounted on pad receptacles 90 having grooves 92 running transversely across the receptacle to allow for lateral adjustment of the pads 40 through retraction of the pad retaining pin 49, lateral movement of the receptacle 90 to a new pin setting and resetting of pad retaining pin 49.

Reservoirs 94, 96 and 98 provide respectively for an air reservoir for compensation of air volume restrictions in the various air cylinders used in the scrum machine, an air reservoir for the tighthead forward thrusting ram 26 and an air reservoir for the loosehead forward thrusting ram 26. A center support 99 extending on either side of the frame 10 provides support for a cover 101. A side support 87 also provides an anchor point for the cover 101. The cover 101 may be hollow to act as a water tank to give variable mass for the scrum machine. An indicator 97 may be used to provide an indication of water level.

A control panel 100 mounted conveniently on one side of the scrum machine on a control panel support 103 provides a convenient and easily accessible place for the controls for the active components of the scrum machine.

Loosehead pressure regulator 102 adjusts pressures in the loosehead forward thrusting ram 26. Loosehead joystick control 104 controls pressure to the loosehead forward thrusting ram 26, corresponding actuator arm 16 and corresponding angle actuator 38 so as to effect controlled articulation of the rams 26. A reset button 106 releases all pressures and resets the contact pads 40 to a starting position (for example shown in FIG. 1). By using the reset button 106 a practice can be terminated at any time. A loosehead thrust indicator 108 displays thrust pressure and records peak pressure attained by a practising scrum on the loosehead side. A steering control 110 adjusts the direction of the scrum machine from the control panel 100. A contact resistance control 112 adjusts resistance to initial impact applied by a practising scrum. A cush control 114 adjusts the volume in the air cylinders of the forward thrusting rams 26 so as to allow for a controlled rate of pressure absorption. A greater volume of air results in increased cushioning. A brake regulator 116 controls and adjusts the braking pressure. Tighthead pressure regulator 118 adjusts pressures in the tighthead forward thrusting ram 26. Tighthead joystick control 120 controls pressure to the tighthead forward thrusting ram 26, corresponding actuator arm 16 and corresponding angle actuator 38. A tighthead thrust indicator 122 displays thrust pressure and records peak pressure attained by a practising scrum on the tighthead forward thrusting ram 26. A manual reset button 124 defeats built-in auto-reset function to allow machine to operate as a sled.

A control panel cover (not shown) may be used to cover the control panel. Conduits for the supply of air to the cylinders and pumps for the air are not shown, but various known ways in the art of pneumatics may be used to supply and control flow of air to the cylinders. A weatherproof bellows boot 130 preferably encases the actuator arm 16 to provide protection from the elements and minimize exposed parts. A neoprene cover 132 is preferably used to protect the pads 40.

Figure 4:
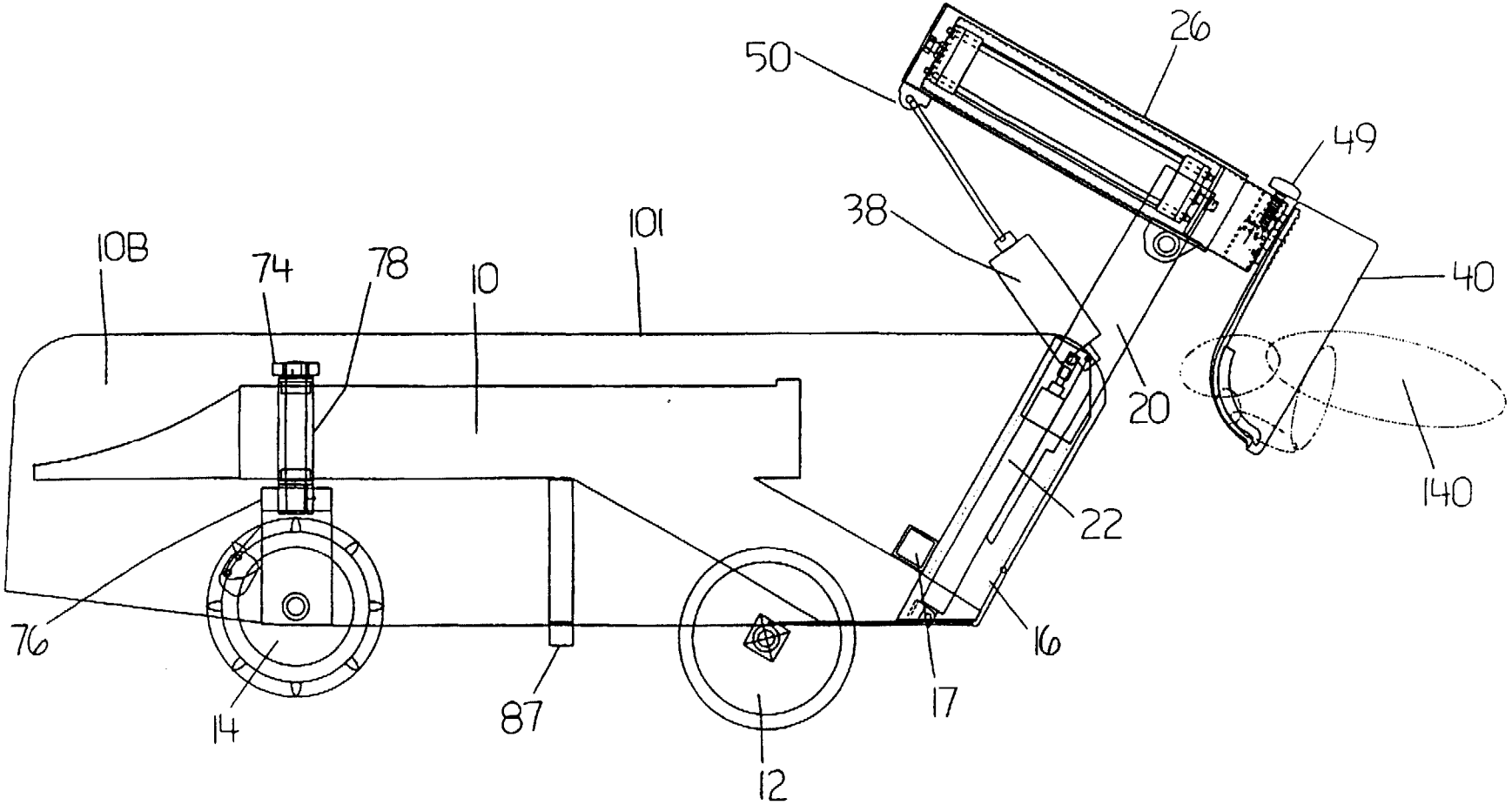
FIGS. 4, 5 and 6 are respectively side view schematics of the embodiment of FIG. 1 in first, second and third operating positions.
Figure 5:
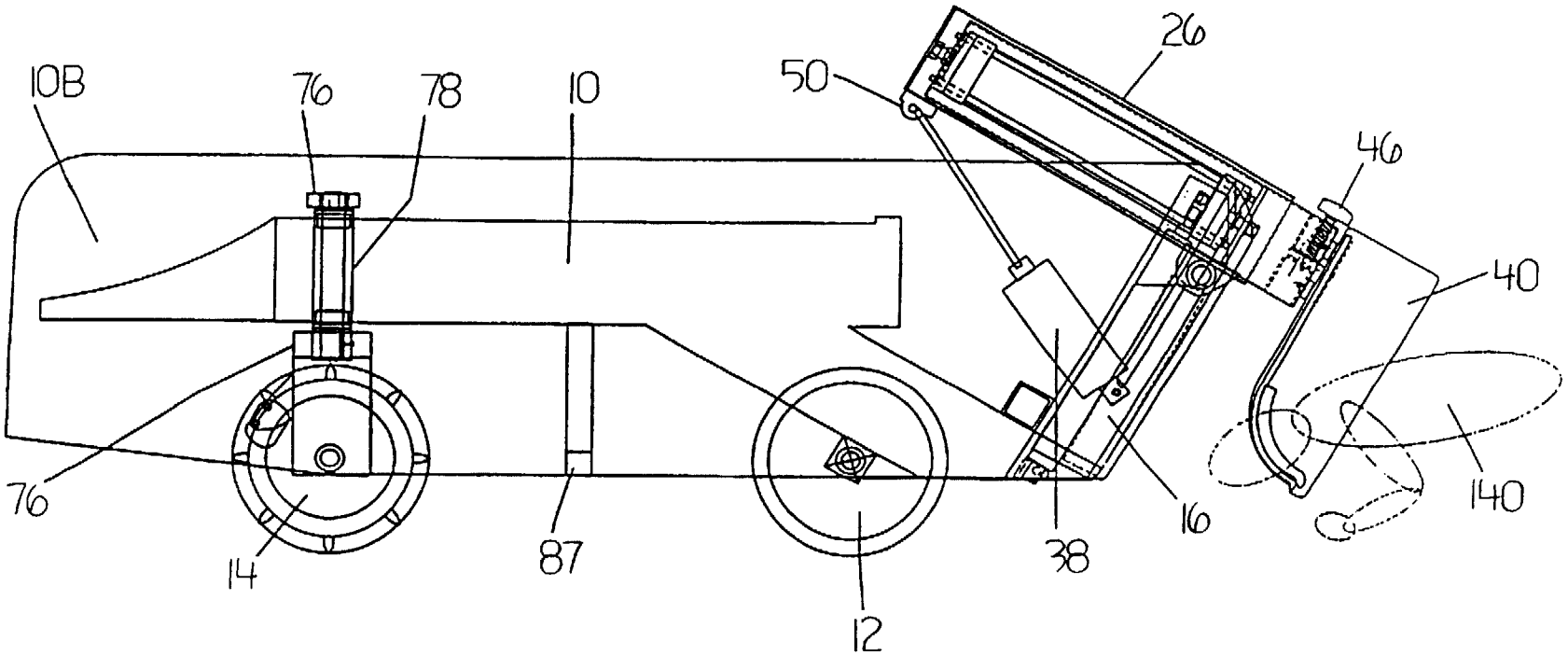
Figure 6:
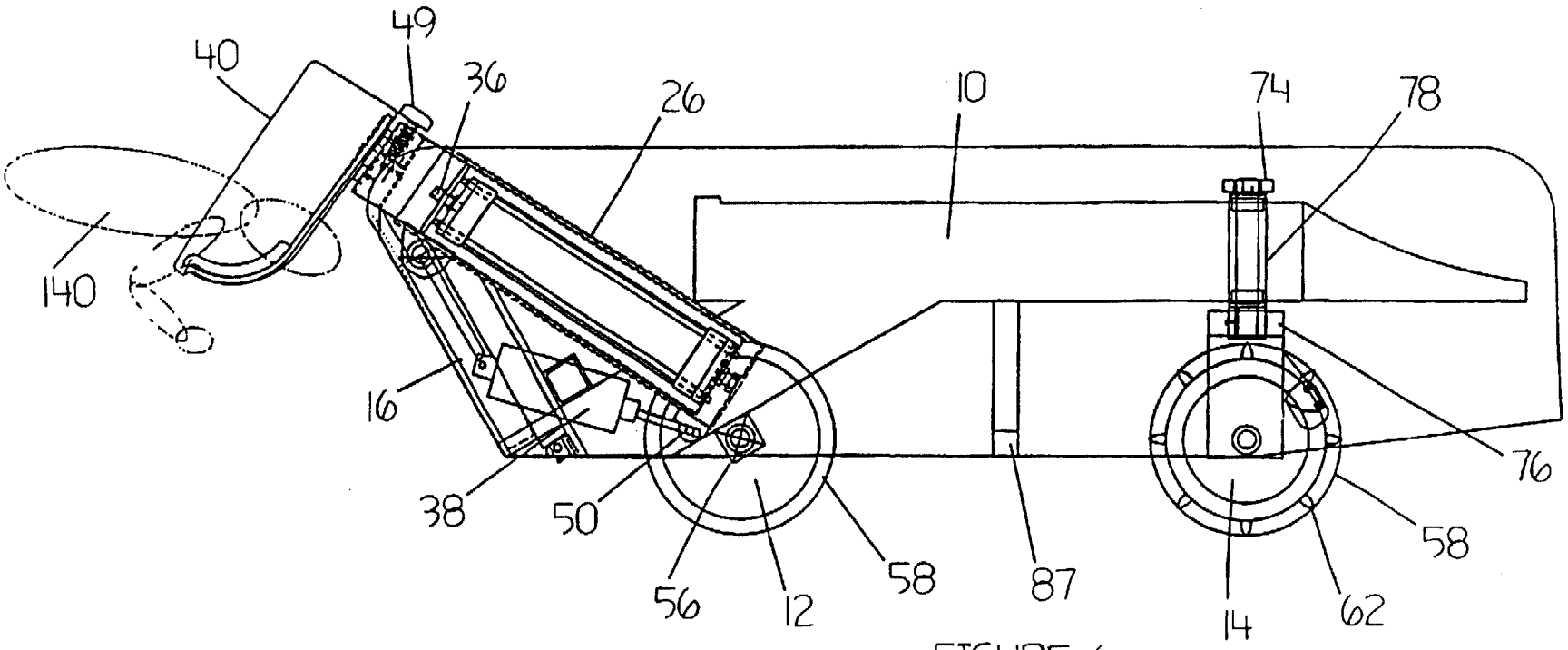

Referring now to FIGS. 4, 5 and 6, the operation of the scrum machine is illustrated. FIG. 4 shows the extendable actuator arm 16 fully extended, while the forward thrusting ram 26 is fully retracted and the angle actuator 38 also fully extended. A position of a player 140 is shown against the pad 40. FIG. 5 shows the extendable actuator arm 16 fully retracted and the angle actuator 38 fully extended to give a strong downward pushing position for the forward thrusting ram 26 shown in retracted position. An operator may now activate the forward thrusting ram 26 to provide a thrust against the player 140. In the position shown in FIGS. 4 and 5, the forward thrusting ram 26 may exert a downward active thrust and passively resist upward forces against it. FIG. 6 shows the extendable actuator arm 16 in retracted position and the angle actuator 38 in retracted position to provide an upward thrusting motion of the forward thrusting ram 26 shown in retracted position. From this position the forward thrusting ram 26 may be activated to push upward against the player 140. Accordingly, the forward thrusting ram 26 may provide active thrusting forces and passive resistance against forces in planes that are not horizontal and that are at variable heights.

The extendable actuator 16 may therefore be operated in conjunction with the thrusting rams 26 so that the direction of pressure or resistance of the pads varies while the height of the head remains the same, thus mimicking a real scrum situation. The joystick controls 104 and 120 may be operated while a player is in contact with a pad 40 to vary the direction of thrust or resistance during the player's contact with the head without changing the height of the pad.

The scrum machine can be adjusted according to the operator's wishes in several ways. The pneumatic pressure to either or both rams 26 may be adjusted, as well as the angle and height of the rams 26 in relation to the ground. Peak pressures may be recorded for future reference. Cushioning of hits on the pads by use of pneumatics allows for passive absorption when initial contact is made. The two rams 26 may be independently operated to mimic a game situation, or allow players to practice different skills or at different skill levels at the same time. Range of travel of the rams 26 may be in the order of 20 inches. Steering of the rear wheels can mimic the wheeling of a scrum. Hand grips (not shown, but known in the art) on the heads 28 may be used to give the player a better grip. It is preferred that each of the forward thrusting ram, the angle actuator and the extendable actuator arm be fully pneumatically operated and not assisted by springs.

Pneumatically controlled braking provides a means of presetting and resetting resistance of the scrum machine to a norm or standard. The braking actuator may be programmed to have a set or variable resistance, with timed sequences having different resistances at different times and for different durations. The scrum machine preferably is low, entirely configured below the height of an operator, for example below 4 feet, so that the operator can see all sides from the operator control.

Air cylinder assembly 70 is made from two double acting cylinders mounted cap to cap as shown in FIG. 1. Retraction of both cylinders causes the wheel 14 to rotate clockwise (when looking from above, as in FIG. 2). Extension of both cylinders causes the wheel 14 to rotate anti-clockwise. Retraction of one cylinder and extension of the other causes the wheel 14 to be in the position shown in FIG. 2.

Figure 7:
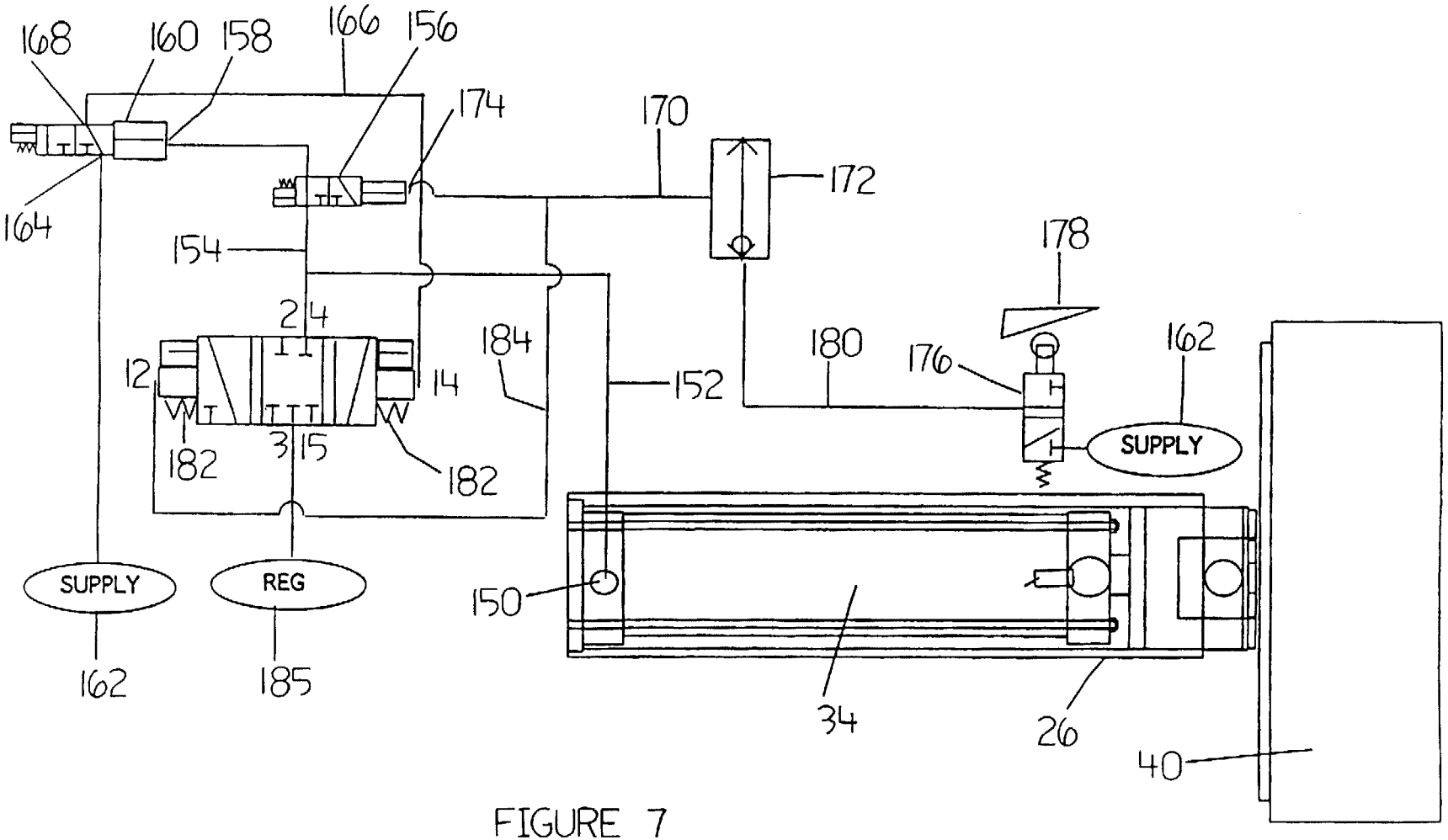
FIG. 7 is a circuit schematic of the initialization system for automatic operation of the scrum machine of FIG. 1.

The scrum machine of the invention may be operated automatically if it is desired, so that no operator is required. Referring to FIG. 7, a forward thrusting ram 26 with pad 40 and air cylinder 34 is shown. Air cylinder 34 is connected via port 150 and line 152 to 5 port, 3 position valve Q and via line 154 to 3 way normally open interrupt valve 156. The line 154 continues through valve 156 to the pilot input port 158 of low pressure piloted 3 way valve 160. Air supply from a supply 162 is provided to the valve 160 at port 164. A line 166 connects the output port 168 to pilot input port 14 of valve Q. The valve Q is connected to pressure regulator 185, whose pressure output is set to a desired reference pressure. Air flows from regulator 185 through port 1 to port 4 of valve Q and thence along line 152. An output line 170 from shuttle valve 172 connects to the pilot input 174 of valve 156, and to pilot input 12 of valve Q. Shuttle valve 172 receives input from any of various reset devices, such as valve 176. Valve 176 is set to be triggered by full extension of the forward thrusting ram 26 via trigger 178. Opening of valve 176 provides air from the supply 162 along line 180 as a signal for the shuttle valve 172.

In the automatic operation of the scrum machine, firstly, a reference pressure is selected that is believed to be sustainable by a forward or scrum pushing on one of the pads 40. The reference pressure is then set by adjustment of reference pressure regulator 162. Operational pressures in the cylinders used for the elevation tower 18 and angle actuator 38 are also set by operator selection to set the actual vertical position and orientation of the forward thrusting rams 26. In manual mode, the height and orientation of the forward thrusting ram 26 may be changed by control of air flow to their respective air cylinders. In automatic mode, the height and orientation of the forward thrusting ram are set to some desired height before initializing the scrum machine. In addition, in automatic mode, the brake is preferably fully engaged and the steering wheel set to center.

Pressure in the lines supplying the valve Q is first built up to operational pressure. Upon a player impacting the forward thrusting ram 26, air in the cylinder 34 compresses and provides a flow of air along line 152 through normally open valve 156 to the pilot input 14, thus biasing the valve Q to the 1-4 position, whereby air flows from the regulator 185 along line 152 to the cylinder 34. By this manner, the valve Q senses the impact of the player on the ram and causes operational air supply to the cylinder 34. Air continues to flow in this line until a reset action occurs. Pressured air is also supplied to the other air cylinders to force them into a preset operational position.

Pressure in the air cylinder 34 is held at a stable state until termination of the cycle. Termination of the cycle occurs when any of the following events first occurs: (1) the forward thrusting ram 26 reaches the end of its stroke (which can be signalled by sensor/valve 176 on the forward thrusting ram), (2) an emergency off signal is received from an emergency shut off valve connected to the shuttle valve 172 and (3) the user successfully holds the applied reference pressure for a preset period of time. For timing of this preset period, a timer may be triggered by pressure in the thrust cylinder 34 reaching the reference pressure. This can easily be accomplished using a comparator valve to compare the two pressures and trigger filling of a timing volume chamber when the pressures are equal. If the pressure in the thrust cylinder 34 falls, then the timing cycle will stop and the volume chamber will stop filling. If at any time, pressure in the thrust cylinder 34 again reaches reference pressure, then the timer cycle begins again. An audible signal may be used to alert the user that the reference pressure has been reached in the air cylinder of the forward thrusting ram.

Upon completion of the timing cycle, that is, when the timing volume chamber is filled, a sample of the achieved pressure can be routed to a pressure guage to record this pressure. In addition, when the timing cycle is complete, the pressure applied to the thrust cylinder 34 and the other air cylinders can be released and the air cylinders can be retracted by introducing return air to the air cylinders. The system may be reset upon detection of the forward thrusting ram reaching its fully retracted state.

Resetting of the cylinder 34 is accomplished as follows. When a reset flow or signal is output from shuttle valve 172, as for example by the forward thrusting ram reaching the end of travel and opening valve 176, air flow along line 170 operates pilot valve 156, closing the flow of air to the pilot 14. Valve Q then biases itself to the neutral position with an internal spring 182. At the same time, flow of air along line 184 operates pilot 12, which opens the line 4-5, allowing air to bleed out of the air cylinder 34 along line 152. At the same time, air may be supplied to the retract side of the air cylinder to force the air cylinder 34 to the initial position. Reset flow along line 170 may thus occur due to timing out of pressurized operation of the air cylinder 34 at the reference pressure, manual override or full extension of the air cylinder 34.

For dual automatic operation of the forward thrust cylinders, both thrusting air cylinders are pressurized and the timing cycle only begins when both air cylinders reach the reference pressure. Once pressure in both air cylinders 34 has been held for the timing cycle, then both are retracted. A tone may be sounded when one of the forward thrusting rams is at the reference pressure, and a different tone when the other of the forward thrusting rams is at the reference pressure, thus permitting players to compete against each other to reach the reference pressure first.

It will be understood that each air cylinder 22 and 34 and the air cylinder of angle actuator 38 has a pressure side and a retraction side. Supply of air pressure to the pressure side causes extension of the air cylinder, while supply of air pressure to the retraction side causes retraction of the air cylinder. Increased (decreased) pressure in the expansion chambers 96 and 97 causes a decrease (increase) in the amount of travel of the forward thrusting rams upon contact of the pads 40 by a user, and increases (decreases) the rate of pressure increase applied to a user.

Air supply to the air cylinders 34 may be controlled by a cycling valve. This cycling valve has two states: (1) the pressure side of the air cylinder 34 is sealed to atmosphere, while the lee side is aspirated, with no supply of air to the retraction side and no interruption of supply of air to the pressure side; and (2) air supply to the pressure side is interrupted, the pressure on the pressure side of the air cylinder 34 is aspirated, and retraction air is supplied to the air cylinder 34.

The scrum machine may be supplied air through a compressor, not shown, or it may be supplied air through reservoirs mounted on board the scrum machine. In the latter case, since operation of the air cylinders 22, 34 and 38 bleeds air to atmosphere, operation of the scrum machine is time limited.

A person skilled in the art could make immaterial modifications to the invention described and claimed in this patent without departing from the essence of the invention.

The embodiments of the invention in which an exclusive property or privilege is claimed are defined as follows:

1. A scrum machine comprising:

a frame having a forward end including a structural member, a rearward end, an upper side, a lower side and a ground engaging support, a direction from the lower side to the upper side defining an upward direction, a direction from the rearward end to the forward end defining a forward direction and a direction perpendicular to both the forward direction and the upward direction being a horizontal direction;

at least a first extendable actuator arm telescopically mounted on the structural member at the forward end of the frame and extendable upwardly away from the structural member;

a first pivot oriented horizontally on the first extendable actuator arm, whereby the pivot is height adjustable by extension of the first extendable actuator arm;

a first forward thrusting ram pivotally mounted on the first pivot, the first forward thrusting ram being locatable in selected angular positions about the first pivot; and a first pad mounted on the first forward thrusting ram for engagement by a user.

2. The scrum machine of claim 1 further including a first actuator means operably connected to the first forward thrusting ram for controllably changing angular positions of the first forward thrusting ran about the first pivot.

3. The scrum machine of claim 2 in which the first actuator means is pivotally attached to an end of the first forward thrusting ram remote from the first pad.

4. The scrum machine of claim 3 in which the first actuator means is pivotally mounted on the first extendable actuator arm.

5. The scrum machine of claim 2 in which the first forward thrusting ram is solely pneumatically operated.

6. The scrum machine of claim 5 in which each of the forward thrusting ram, the first actuator means and the extendable actuator arm are each solely pneumatically operated.

7. The scrum machine of claim 2 further including a control for the extendable actuator arm and the angle actuator whereby the extendable actuator arm and the angle actuator may be operated at the same time while a player is in contact with the forward thrusting ram to maintain the forward thrusting ram at a given height while changing its direction.

8. The scrum machine of claim 1 in which the first extendadle actuator arm extends forwardly from the structural member.

9. The scrum machine of claim 8 further including a first actuator means for controllably changing angular positions of the first forward thrusting ram about the first pivot.

10. The scrum machine of claim 9 in which the first actuator means is pivotally attached to an end of the first forward thrusting ram remote from the first pad.

11. The scrum machine of claim 10 in which the first actuator means is pivotally mounted on the first extendable actuator arm.

12. The scrum machine of claim 1 in which the ground engaging base includes:

at least a front wheel mounted on the forward end of the frame; and a rear wheel mounted for steering about a substantially vertical axis on the rearward end of the frame.

13. The scrum machine of claim 12 in which the rear wheel has an adjustable resistance brake.

14. The scrum machine of claim 13 further including a braking actuator for controllably operating the adjustable resistance brake.

15. The scrum machine of claim 12 further including a steering actuator for controllably steering the rear wheel.

16. The scrum machine of claim 15 further including a braking actuator for controllably operating the adjustable resistance brake.

17. The scrum machine of claim 1 further including:

a second extendable actuator arm mounted on the forward end of the frame and extending away from the ground engaging base;

a second forward thrusting ram pivotally mounted on a second pivot on the second extendable actuator arm and locatable in selected angular positions about the second pivot; and a second pad mounted on the second forward thrusting ram.

18. The scrum machine of claim 1 in which the ground engaging base includes:

at least a first wheel mounted for steering about a substantially vertical axis on the frame; and the first wheel having an adjustable resistance brake and a braking actuator for controllably operating the adjustable resistance brake.

19. The scrum machine of claim 1 in which the ground engaging base includes:

at least a first wheel mounted for steering about a substantially vertical axis on the frame; and a steering actuator for controllably steering the first wheel.

20. The scrum machine of claim 1 further comprising:

a hollow cover for the scrum machine, wherein the hollow cover may act as a water tank to give variable mass to the scrum machine.

21. In a method of operating a scrum machine, which scrum machine includes a padded forward thrusting ram engageable by a person practising rugby, and in which method forward thrust pressure is applied to the forward thrusting ram to mimic scrummaging, the improvement characterized by;

selecting a reference pressure;

setting a pressure regulator to the reference pressure; and automatically maintaining pressure applied to the forward thrusting ram by regulating the pressure with the pressure regulator.

22. In the method of claim 21, the improvement further being characterized by:

sensing with a sensor contact of a player with the padded forward thrusting ram; and automatically applying forward thrust pressure to the forward thrusting ram upon sensing of contact of a player with the forward thrusting ram.

23. In the method of claim 22, the improvement further being characterized by:

automatically applying forward thrust pressure by providing a signal from the sensor to an automatic controller and the automatic controller opening a valve, in response to the signal, to supply fluid to the forward thrusting ram and cause the forward thrusting ram to resist pressure from the player.

24. In the method of claim 21, the improvement further being characterized by:

automatically maintaining pressure applied to the forward thrusting ram by regulating the pressure with the applied to the forward thrusting ram by the player.

25. In the method of claim 21, the improvement further being characterized by:

automatically maintaining pressure applied to the forward thrusting ram by regulating the pressure with the pressure regulator for a preset period.

26. In the method of claim 21, the improvement further being characterized by:

automatically terminating pressure applied to the forward thrusting ram upon the forward thrusting ram being fully extended.

27. A scrum machine, comprising:

a frame having a forward end including a structural member, a rearward end, an upper side, a lower side and a ground engaging support, a direction from the lower side to the upper side defining an upward direction;

a first forward thrusting ram pivotally mounted on the structural member;

a first pad mounted on the first forward thrusting ram for engagement by a user; and means for supplying and maintaining a pre-set pressure to the forward thrusting ram.

28. The scrum machine of claim 27 further comprising:

means for terminating the pressure applied to the forward thrusting ram upon receipt of a control signal.

29. The scrum machine of claim 28 further comprising:

a sensor responsive to the forward thrusting ram being fully extended to produce the control signal.

* * * * *